United States Patent [19]

Kennedy

[11] Patent Number: 4,883,012

[45] Date of Patent: Nov. 28, 1989

[54] DUAL-PURPOSE WATER CRAFT

[76] Inventor: George D. Kennedy, Rte. 2, Box 109-B, Reliance, Tenn. 37369

[21] Appl. No.: 253,192

[22] Filed: Sep. 30, 1988

[51] Int. Cl.[4] ..... B63B 1/10; B63B 3/08

[52] U.S. Cl. ..... 114/61; 4/494; 4/495; 114/77 A

[58] Field of Search ..... 114/61, 264, 260, 270, 114/77 A; 441/43; 4/487, 494, 495

[56] References Cited

U.S. PATENT DOCUMENTS

| | | | |
|---|---|---|---|
| 1,054,505 | 2/1913 | Butters | 4/487 |
| 1,583,127 | 5/1926 | Curtis | 4/487 |
| 3,934,530 | 1/1976 | Kossa et al. | 114/260 |

*Primary Examiner*—Sherman D. Basinger
*Attorney, Agent, or Firm*—Roger L. Martin

[57] ABSTRACT

A recreational water craft useable as a vehicle and as a swimming facility has first and second floatable components, the first having a deck supported by a pair of compartmented pontoons. The compartments have water and air inlet and discharge facilities and are adapted for flooding and blowing by connection with a control system that includes a pressurized air source and valves for pressurizing and bleeding air from the compartments so as to move the first component between a first position with the deck above water and a second position with the deck submerged. The second floatable component has a main floatable section with an annular pontoon that rests on the deck during the vehicle mode of use as when the first component is at the first position. The pontoon has a vertical opening and which surrounds the deck passenger area. A floatable aft section is pivotally connected to the main section and provides a mounting place for an outboard motor. To convert to the swimming pool mode of use, the compartments of the first component are flooded so that the component sinks and becomes suspended from the second component which assumes a floating position. In this mode the two components cooperate in defining the surface area, bottom portion and side wall portions of the swimming facility.

8 Claims, 5 Drawing Sheets

DUAL-PURPOSE WATER CRAFT

BACKGROUND OF THE INVENTION

This invention relates to a water craft and more particularly to a recreational water craft that may be used as a vehicle and also as a swimming facility.

One of the more common recreational water craft used as a vehicle for passenger transportation about small lakes, rivers and other inland waterways is a craft that basically comprises a float system which supports a flat deck structure that serves as a passenger area, the float system being propelled through the water by one or more attached outboard motors.

The float system is usually made up of a pair of elongated pontoons that are laterally spaced apart and physically connected in a parallel side-by-side arrangement. The arrangement provides the support for the flat deck structure which, as indicated above, serves as the passenger area of the recreational vehicle. Various different types of seating accommodations are provided for the passengers depending on the design of the craft and manufacturer's contemplated market for it. In many of the craft, the passengers are simply seated on collapsible chairs which rest upon and may be moved about the deck at the pleasure of the user. An appropriate side rail is usually provided around the passenger area, and the craft, as indicated before, is usually propelled through the water by means of one or more outboard motors that are mounted in the aft area of the craft and frequently controlled from an operating console provided in the passenger area. The water craft of the invention is, in some respects, similar to such types of recreation water crafts.

In the United States, many rivers have been dammed up to control flooding and provide hydroelectric power, the Federal government projects along the Tennessee Valley being examples of such flood control and power projects. The river waters are backed up by the dams in many instances in land areas where the contour of the land is so steep before flooding that, after flooding, there is a dangerous drop-off into deep water in the immediate proximity of the shoreline of the artificial body of water that is created by the project. As such, recreational bathing and swimming is limited along the shoreline because of the danger of drowning which is forever threatening the poor swimmer and which is especially threatening to children and adolescents who use the back-up waters for recreation bathing.

The need exists for a safe place for inexperienced swimmers to bath and swim in the recreational waters created by damming up rivers in mountanous areas as well as in any waters that are otherwise dangerous to inexperienced swimmers because of the water depth and/or uncertain bottom formations.

SUMMARY OF THE INVENTION

A general object of the invention is to provide a water craft that is adapted and arranged to float on the surface of a water body and has the capability of being used as a recreational vehicle for the transportation of people and also as a facility for swimming and bathing.

In accord with the invention the water craft has a first floatable structure with a deck and controllable means for moving the structure between first and second positions at which the deck is respectively located above and below the surface of the water. The craft also has a second floatable structure with an attached propulsion system and which has a vertical opening that overlies the deck. This second floatable structure is supported by the first structure when the deck is located above the water and the craft is adapted for the vehicle mode of use. Under such circumstances, the deck area beneath the vertical opening provides an area for carrying passengers.

The second structure is arranged to float on the water surface when the first structure is submerged to its second position. The second structure, in the swimming mode of use, defines the surface area of a swimming pool within the vertical opening while the submerged deck provides the bottom portion of the swimming pool. The structures are interconnected and so arranged, when the first structure is at the submerged second position, as to cooperate in providing the side wall portions of the swimming pool. As such, by causing the first structure to become submerged, the craft is convertible to a swimming facility.

The first floatable structure, in accord with certain aspects of the invention, has a pair of elongated hulls that are laterally spaced apart in a deck supporting arrangement. Each hull, in accord with other aspects of the invention, has a pair of water tight compartments that are respectively located fore and aft in the structure, and each compartment has a means for admitting and discharging both air and water from the compartment.

Each compartment is equipped with a water passageway for admitting water to the compartment. In accord with certain aspects of the invention, the water passageway has a one-way valve that is mounted between the water inlet and outlet of the passageway for limiting the direction of water flow in the passageway, as will be subsequently seen. Each compartment is also equipped with a water passageway for discharging water from the compartment. In accord with certain aspects of the invention, the water passageway in this instance has a one-way valve that is mounted between the water inlet and outlet for again limiting the direction of water flow in the passageway, as will be subsequently seen. In addition to the water passageways, each compartment also has passageway means for admitting and discharging pressurized air from the compartment and which, in accord with certain aspects of the invention, is connected to the controllable system for moving the submersible component between its positions.

In accord with other aspects of the invention the second floatable structure has a main section and a separately floatable aft section which is pivotally connected for movement about a horizontal pivot to the main section. The propulsion system involves an outboard motor which is mounted on the aft section and pivotally movable therewith and all in an arrangement such that the motor pivots from an operating position when the first structure is in the first position to an inoperative position when the first structure is in its second position.

Other aspects of the invention will be apparent from the following disclosure.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in conjunction with the accompanying drawings, in which:

DESCRIPTION OF EMBODIMENT

Figure 1:
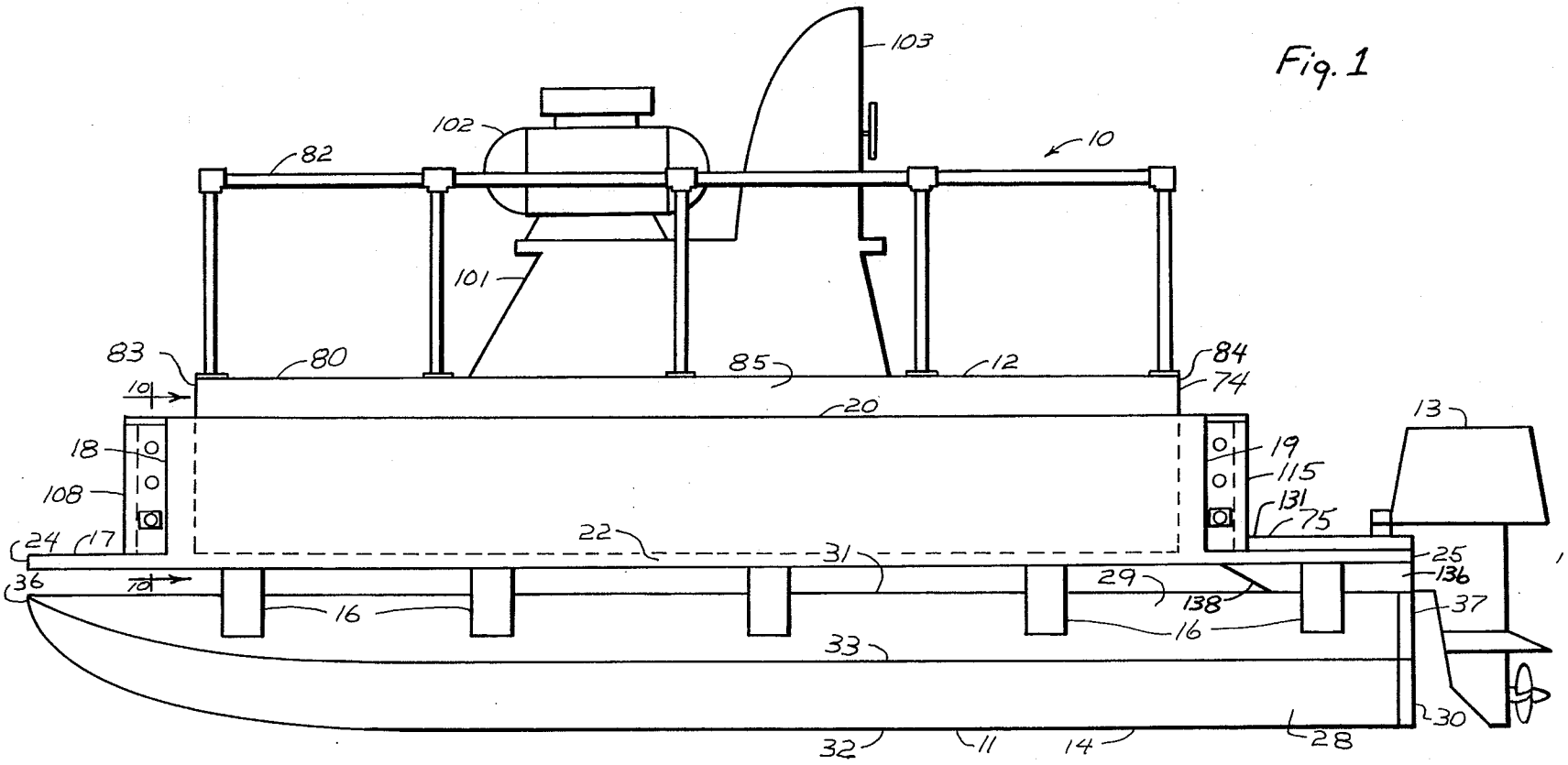
FIG. 1 is a side elevational view of a water craft embodying the principles of the invention and as adapted for use as a vehicle.

Reference is now made to the drawings and wherein a water craft embodying the principles of the invention is designated at 10. The craft 10 is adapted and arranged to float on the surface of a body of water and has a bottom component 11 that serves as a first floatable structure, a top component 12 that is moveable relative to the bottom component 11 and serves as a second floatable structure, and an outboard motor 13 which is connected to the top component 12 for propelling the craft through the water.

The bottom component 11 of the craft 10 has a pair of elongated hulls 14 and 15 that are laterally spaced apart. Each hull forms a pontoon that is equipped with a plurality of longitudinally spaced apart brackets 16 along the top of the pontoon. A flat generally retangular deck 17 section of the bottom component 11 of the craft rests upon and is fixed to the pontoon brackets 16.

The bottom component 11 also has upright fore and aft side walls 18 and 19 as well as upright port and starboard side walls 20 and 21. These walls 18 thru 21 are formed integral with the structure of the deck 17 in the instant arrangement and may be made of wood, plastic or any suitable material. The lateral side walls 20 and 21 are arranged upright at the lateral side edges 22 and 23 of the deck 17, whereas the fore and aft side walls 18 and 19 are also arranged upright on the deck 17 but are inwardly offset from the front and rear edges 24 and 25 thereof.

At the rear end of the deck 17, the deck has a rectangular opening 26 which is generally located between the pontoon forming hulls 14 and 15 and intermediate the lateral side edges 22 and 23 of the deck 17. This opening 26 is provided to facilitate the location of a motor supporting aft section 75 of the top component 12 of the water craft, as will be subsequently seen.

Figure 7:
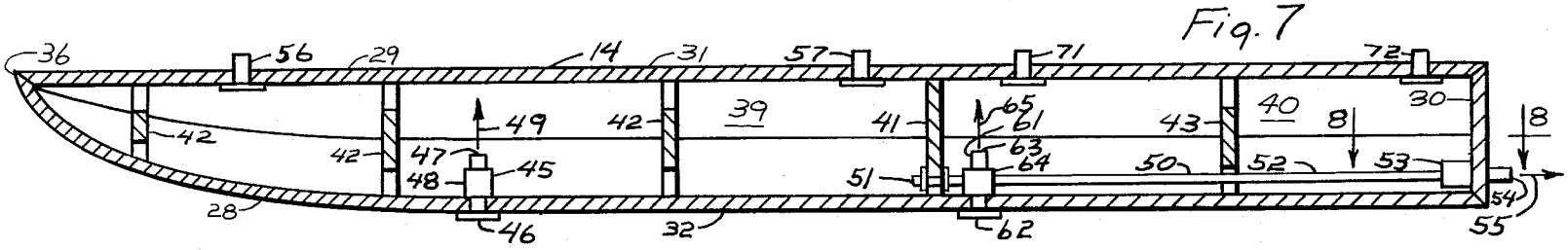
FIG. 7 is a longitudinal vertical sectional view through the hull of one pontoon and as taken generally along the lines 7—7 of FIG. 3.
Figure 3:
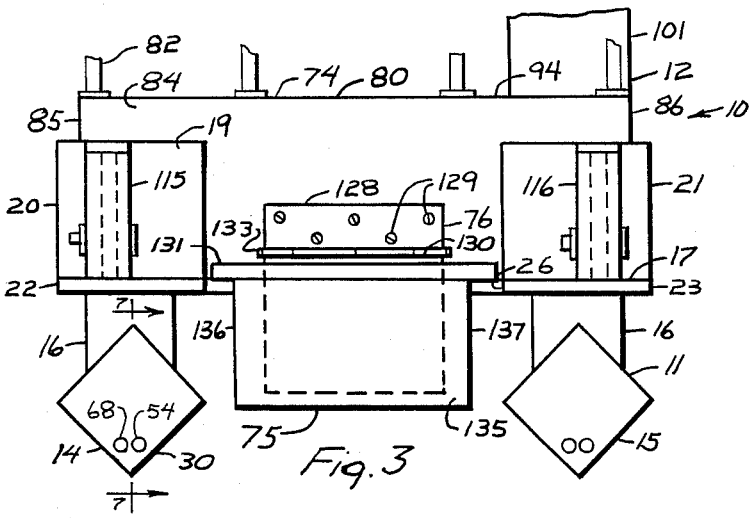
FIG. 3 is a rear elevation view of the water craft seen in FIG. 1, certain parts being broken away and others removed.
Figure 5:
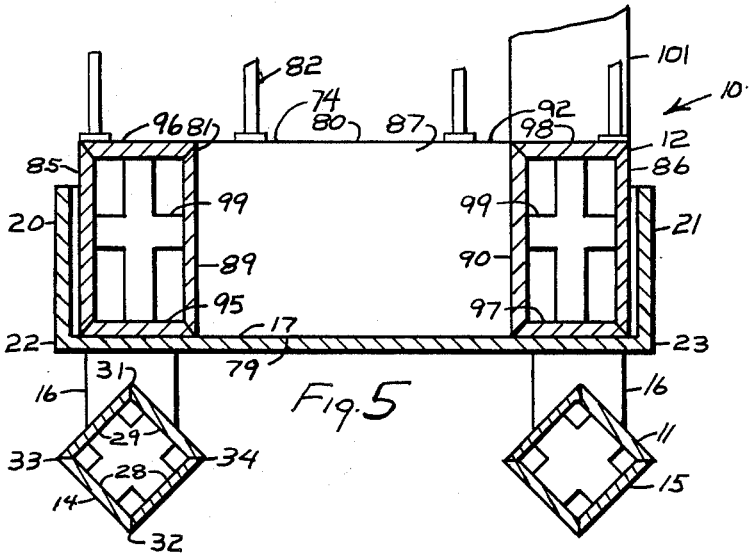
FIG. 5 is a transverse vertical sectional view of the water craft as taken along the linew 5—5 of FIG. 2, certain parts being broken away.

Throughout most of their lengths, the hulls 14 and 15 are a generally rectangular box-like structure and are so arranged in the structure of the floatable bottom component 11 (FIGS. 1 and 5) that one edge 32 provides the bottom extremity of the pontoon whereas another edge 31 provides the upper extremity of the pontoon. This arrangement facilitates the admission and discharge of water from the compartments of the pontoons, as will be subsequently seen. At the fore end 36 of the craft 10, the pontoons are appropriately streamlined whereas at the aft end 37 the pontoons exhibit a square transverse configuration (FIG. 3). The structure of the pontoons is evident from a consideration of the structure of the left hull 14 as seen in FIGS. 3, 5 and 7. The pontoon forming hull 14 has a pair of elongated lower walls 28 (FIG. 5) that are joined together to form the lower edge 32 of the pontoon and a pair of elongated upper walls 29 that are joined together to form the upper edge 31 of the pontoon. These wall pairs are, in turn, joined together along the lateral outer and inner edges 33 and 34 of the pontoon.

Througout the rear three-quarters of the pontoons, these walls 28 and 29 have substantially the same width and are joined in a generally rectangular box-like structure that is capped at the aft end 37 of the hull 14 by a square aft end wall component 30.

In the front quarter of the pontoon, the lateral outer edges of the upper walls 29 gradually taper inwardly along the lateral edges 33 and 34 of the hull toward their joined inner edges at the upper edge 31 of the pontoon forming hull 14 (FIGS. 1 and 7). In the front quarter of the pontoon, the lateral edges of the lower walls 28 are arcuately contoured to follow and conform to the gradual inward taper of the lateral edges of the upper walls 29. On the other hand, the inner edges of the lower walls 28 that are joined along the lower edge 32 of the hull 14 are contoured to provide an upwardly sweeping contour in the lower wall structure at the bow end of the pontoon as is evident from the drawings.

Internally, the space enclosed by the hull walls 28–30 is divided into a water tight fore compartment 39 and a water tight aft compartment 40 by an internal, transversely arranged, water tight bulkhead 41 which is generally rectangular in configuration and which is sealed and joined along its edges to the interior of the hull walls 28 and 29. In the fore compartment 39, the hull is strenghtened by three plates 42 of generally rectangular configuration. These plates 42 are transversely arranged and longitudinally spaced apart in the compartment 39 and are also joined along their edges to the interior of the hull walls 28 and 29. Each plate is provided with corner cutouts that permit water flow between the opposite faces of the plates in the compartment. However, the arrangement is such that each plate serves as a baffle that obstructs rapid fore and aft flow of water in the compartment. The aft compartment 40 has another generally rectangular plate with corner cutouts that is also provided to strengthen the hull and function as a baffle to water movement in the compartment.

The front or fore compartment 39 has a first water passageway 45 for admitting water to the compartment 39. This passageway 45 has a water inlet 46 that communicates with the exterior of the hull at the bottom of the compartment and along the lower edge 32 of the hull 14. The water discharge outlet 47 of the passageway 45 is located above the water inlet 46 and a one-way valve 48 is provided in the passageway 45 between the inlet 46 and outlet 47 for limiting the water flow in the passageway 45 to the inward direction indicated by arrow 49.

It may be mentioned that although the water inlet 46 is at a lower extremety in the hull 14, the passageway outlet 47 is offset in the compartment from the bottom of the hull 14 so as to avoid undesired pumping of water through the passageway 45 for reasons of an excessive hydraulic head at the inlet occassioned by enternal wave action.

The fore compartment 39 also has a second water passageway for discharging water from the compartment. This passageway is designated at 50 and although servicing the fore compartment 39 is mainly located in the aft compartment 40. It has a flexible conduit 52 with a water inlet 51 that communicates with the compartment 39 at the bottom thereof in the proximity of the bottom edge 32 of the hull 14. The conduit 52 extends through the bulkhead 41, along the bottom of compartment 40 and through the end wall 30 where it has a water outlet 54 that communicates with the exterior of the hull 14 just aft of the end wall 30. The passageway 50 has a one-way valve 53 which is interposed between the passageway inlet 51 and outlet 54 for limiting the direction of water flow in the passageway to an outward direction indicated by arrow 55.

The compartment 39 also has means for admitting and discharging compressed air from the compartment, the means being provided in the form of a pair of conduits 56 and 57 that communicate with the compartment 39 and with the exterior of the hull at the top edge 31 of the hull 14 and form respective passageways for the admission and discharge of pressurized air from the compartment. As will be subsequently seen, these passageways 56 and 57 are connected in parallel and to the controllable system for relatively moving the floatable structures.

The aft compartment 40 also has a first water passageway 61 for admitting water to the compartment 40. This passageway 61 has a water inlet 62 that communicates with the exterior of the hull at the bottom of the compartment and along the lower edge 32 of the hull 14. The water discharge outlet 63 of the passageway 61 is located above the water inlet 62 and a one-way valve 64 is provided in the passageway 61 between the inlet 62 and outlet 63 for again limiting the water flow in the passageway 61 to the inward direction indicated by arrow 65. The passageway outlet 63 is again offset in the compartment from the bottom of the hull 14 so as to avoid undesired water pumping for reasons of wave action.

Figure 8:
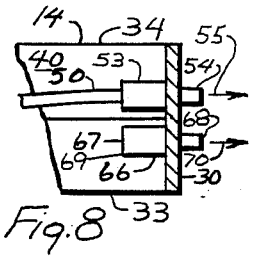
FIG. 8 is a horizontal sectional view of a fragment of the hull of the pontoon as seen along the line 8—8 of FIG. 7.

Compartment 40 also has a second water passageway for discharging water from the compartment. This passageway 66 (FIG. 8) has a water inlet 67 that communicates with the compartment 40 at the bottom thereof in the proximity of the bottom edge 32 of the hull 14 and adjacent the aft end wall 30. The passageway 66 extends through the end wall 30 and the water outlet 68 communicates with the exterior of the hull 14 just aft of the end wall 30 (FIG. 8). At the inside of the end wall 30, the passageway 66 is equipped with a one-way valve 69 for limiting the direction of water flow in the passageway to an outward direction indicated by arrow 70.

Compartment 40 also has means for admitting and discharging compressed air from the compartment, the means being also provided in the form of a pair of conduits 71 and 72 (FIG. 7) that communicate with the compartment 40 and with the exterior of the hull at the top edge 31 of the hull 14 and form respective passageways for the admission and discharge of the pressurized air from the compartment. Like those for compartment 39, the conduits 71 and 72 are connected in parallel and to the controllable system for relatively moving the floatable structures.

The structure of the top floatable component 12 of the water craft 10 is most evident from a consideration of FIGS. 1–6. It has a main section 74 and an aft section 75. These sections 74 and 75 are each capable of floating and are hinged for relative pivotal movement about a horizontal pivot axis by a hinge component 76.

Figure 4:
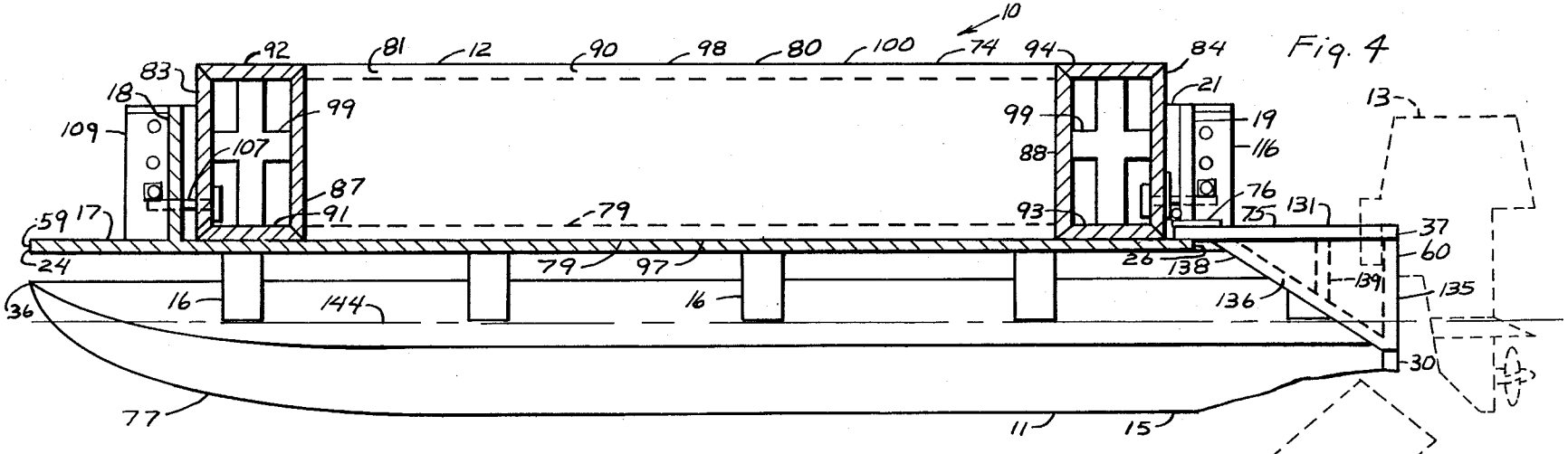
FIG. 4 is a longitudinal vertical sectional view of the water craft as taken generally along the lines 4—4 of FIG. 2, certain parts being broken away, others being removed and still others being shown in broken lines, the craft being shown as viewed in the vehicle mode of use.

The main section 74 includes a hollow annular watertight pontoon 80 which may be filled with buoyant foam material if desired. It has a vertical opening 81 that overlies the deck 17 of the bottom component 11. The section 74 is supported by the bottom component 11 and adapted and arranged to rest on the deck 17 in the space between the upright walls 18–21 of the bottom component 11 when the bottom component is in its first position 77 and the craft is adapted for use as a vehicle (FIG. 4). When the deck 17 is submerged and the bottom component 11 assumes its second position 78 (FIG. 6), the craft is adapted for use as a swimming facility. Under such circumstances, the pontoon 80 floats and the bottom component 11 is suspended in the water therefrom as will be evident subsequently.

Figure 6:
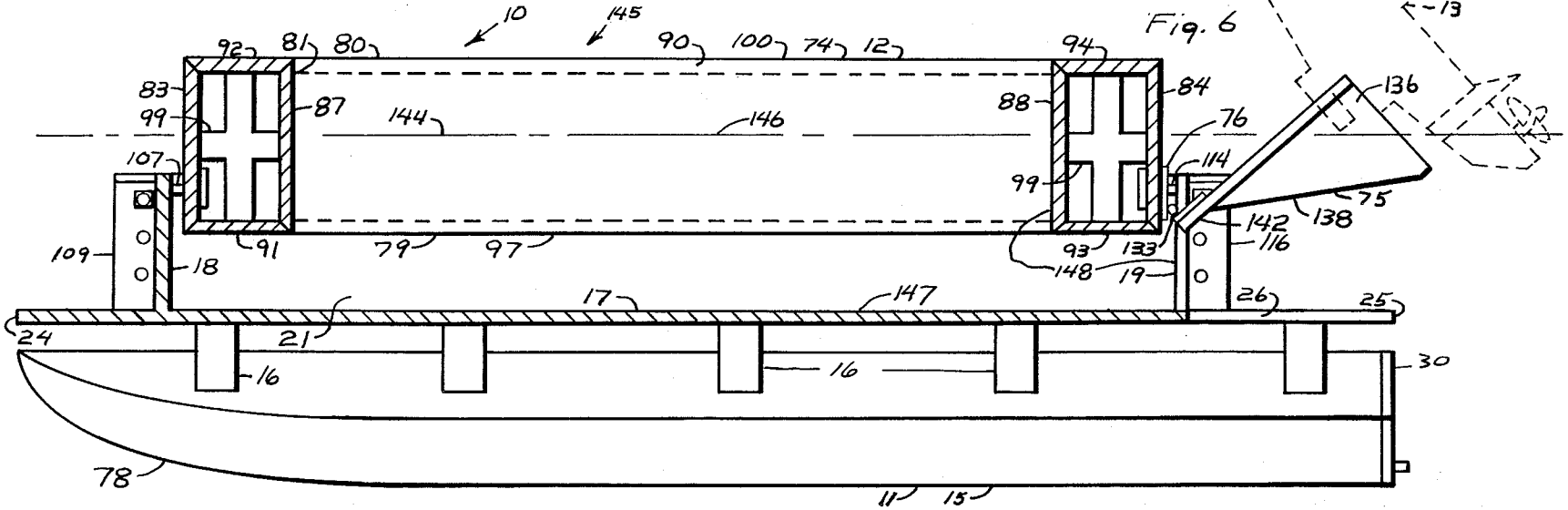
FIG. 6 is a longitudinal vertical sectional view of the water craft similar to that seen in FIG. 4 but under circumstances where the floatable structures are arranged to adapt the water craft for use as a swimming facility, certain parts being again broken away, others being removed and still others being shown in broken lines.

The aft section 75, is normally hinged by the hinge component 76 to the main section 74 through a discontinuity in the upright aft side wall 19 that is located in front of the rectangular opening 26 in the deck 17 of the bottom component 11 when the craft 10 is adapted for use as a vehicle. The outboard motor 13 is mounted on the aft section 75 and this aft section 75 assumes an operative position for the motor 13 between the pontoons of the bottom component 11 when the bottom component 11 is in position 77 and the craft is thus adapted for use as a vehicle (FIG. 4). On the other hand, when the pontoon compartments of the bottom component 11 are flooded and the deck 17 is submerged below the water line to the point that the bottom component 11 assumes the suspended position 78 seen in FIG. 6, the aft section 76 of the top component 12 pivots upwardly and brings the motor 13 to an inoperative position (FIG. 6).

The structure of the main section 74 of the top component 12 is best illustrated in FIGS. 1–6. The annular pontoon 80 has elongated exterior fore and aft walls 83 and 84 and elongated exterior left and right side walls 85 and 86. These walls 83–86 form the perimeter of the pontoon structure 80 and are arranged to fit in the space between the walls 18–21 of the bottom component 11 and in reasonable close proximity thereto when the main section 74 is resting on the deck 17.

In addition to these upright exterior walls 83–86, the structure of the pontoon includes upright interior walls 87–90. Interior fore wall 87 is rearwardly offset from the exterior fore wall 83 (FIG. 4) and is fixed at the fore end 59 of the component 12 to the edges of vertically spaced, transversely extending, and horizontally arranged bottom and top wall components 91 and 92 of the pontoon. Interior aft wall 88 is forewardly offset from the exterior aft wall 84 (FIG. 4) and is fixed at the aft end 60 of top component 12 to the edges of vertically spaced, transversely extending, and horizontally arranged bottom and top wall components 93 and 94. On the port side of the top component 12, the interior left wall 89 is inwardly offset from the exterior left wall 85 (FIG. 5) and is fixed to the edges of vertically spaced, longitudinally extending, and horizontally arranged bottom and top wall components 95 and 96. On the starboard side of the top component 12, the interior right wall 90 is inwardly offset from the exterior right wall 86 (FIG. 5) and is fixed to the edges of vertically spaced, longitudinally extending, and horizontally arranged bottom and top wall components 97 and 98.

In assembling the pontoon structure of the main section 74, internal braces 99 are fixed to the walls and wall components of the structure so as to provide internal strength in the structure. It is evident, of course, that the walls and wall components are adapted and arranged to provide a floatable water tight annular pontoon 80 with a bottom wall 79 that is capable of resting on the deck 17 of the bottom component 11 of the craft 10 and in the space defined by the upright walls 18–21. The bottom wall 79 of the pontoon 74 is, of course, made up of the bottom wall components 91, 93, 95 and 97.

The top wall components 92, 94, 96 and 98 of the pontoon provide a deck 100 that surrounds the vertical opening 81 in the top component 12. At the starboard side of the vertical opening 81, the craft 10 is provided with a structure 101 that provides a mounting place for an air compressor 102 and a console 103 for mounting the conventional outboard motor controls, as well as the control valves of the system 150 to be considered subsequently.

This structure 101 is fixed upright on the top wall component 98 of deck 100. A guard rail 82 is appropriatly mounted on the deck 100 for obvious safety reasons.

The top and bottom components 11 and 12 of the craft 10 are interconnected so that they don't become separated during movement of the bottom component between its first and second positions 77 and 78. Furthermore, the arrangement of the connecting means utilized in the embodiment enables the deck 17 of the bottom component 12 to assume either a horizontal or inclined position when submerged, as will be subsequently seen.

The upright fore wall 18 of the bottom component 11 has a pair of discontinuities that form transversely spaced vertical slots designated at 104 and 105. These slots 104 and 105 are arranged to accommodate the vertical movement of a pair of forwardly projecting pegs 106 and 107 on the pontoon 80 as the bottom component 11 moves relative to the top component 12 between its first position 77 and second position 78. The pegs 106 and 107 are rigidly mounted in close proximity to the bottom wall section 91 of the pontoon 80 and on the upright exterior fore wall 83 thereof.

The upright fore wall 18 of the bottom component 11 has a pair of U-shaped channel members 108 and 109 that are arranged upright on the deck 17 in front of the respective slots 104 and 105 and in an arrangement such that each channel opens rearwardly into the slot. The pegs 106 and 107 in the exterior fore wall 83 of the pontoon extend forwardly through the fore wall slots 104 and 105 and into the space between the lateral side walls of the channel associated therewith.

The upright aft wall 19 of the bottom component 11 has a pair of discontinuities that form transversely spaced vertical slots 111 and 112. These slots 111 and 112 are arranged to accommodate movement of a pair of rearwardly projecting pegs 113 and 114 on the pontoon 80 as the bottom component 11 moves relative to the top component 12 between its first position 77 and second position 78. The pegs 113 and 114 are rigidly mounted in close proximity to the bottom wall component 93 of pontoon 80 and on the upright exterior aft wall 84 thereof.

The upright aft wall 19 also has a pair of U-shaped channel members 115 and 116. These channels are arranged upright on the deck 17 and at the rear of the respective slots 111 and 112 in an arrangement such that each channel opens forewardly into the slot. The pegs 113 and 114 in the exterior aft wall 84 of the pontoon extend rearwardly through the aft wall slots 111 and 112 and into the space between the lateral walls of the channel.

Figure 10:
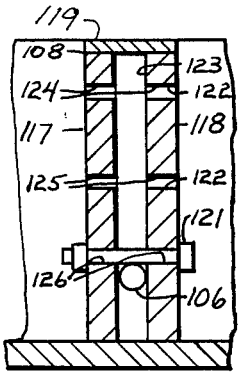
FIG. 10 is an enlarged sectional view through a channel member of the fore wall of the submersible structure together with adjacent structure as taken generally along the lines 10—10 of FIG. 1.

The various channel members 108, 109, 115 and 116 are integrally joined to the deck 17 and to the adjacent upright wall structures of the bottom component 11 of the craft. FIG. 10 is illustrative of the means by which the bottom and top components 11 and 12 are interconnected and how the connection is adjusted. FIG. 10 shows the arrangement between the left side channel member 108 which is located at the fore side wall 18 of the bottom component 11 of the craft 10 and the peg 106 which is mounted on the exterior fore wall 83 of the pontoon 80 and adjacent to the exterior left wall 85 of the pontoon.

Figure 2:
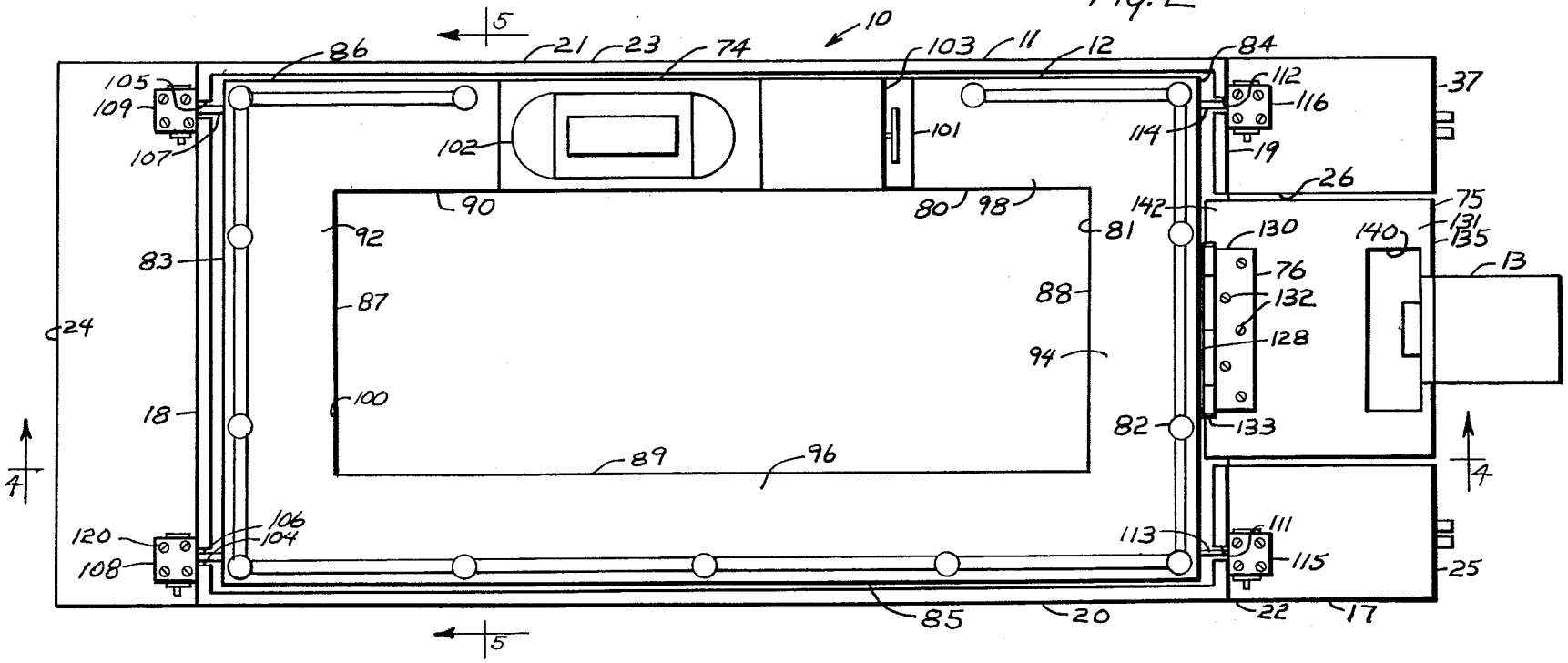
FIG. 2 is a plan or top view of the water craft seen in FIG. 1.

As seen in FIG. 10, peg 106 projects into the space 123 between the lateral walls 117 and 118 of channel member 108. The upper end of the channel member 108 is closed by a square plate 119 that is secured in place by fasteners 120 (FIG. 2). The lateral walls 117 and 118 of the channel member 108 have a series of holes 122 which are arranged in pairs 124, 125, and 126 that are horizontally aligned and located in the respective walls to receive and accommodate a bolt type fastener 121 therein. The bolt type fastener 121, of course, extends through the aligned holes and intervening space between the walls 117 and 118 to limit vertical movements of the peg 106 in the space between the walls.

When the water craft 10 is used to provide a vehicle, the top component 12 rests on the deck 17 of the bottom component 11 and the bolt type fastener associated with each channel member overlies the peg in the channel and is located in the bottom pair of holes in the channel walls so as to avoid relative vertical movements of the craft components 11 and 12. This is exemplified in FIG. 10 where the bolt type fastener 121 is seen extending through the bottom pair 126 of holes and to overlie peg 106.

When the water craft 10 is used as a swimming pool the dept of the pool can be predetermined by selectively adjusting the location of the bolt type fasteners to the upper or middle pairs 124 and 125 of holes in the channel member walls. For example, the bolt type fasteners may be removed from all of the channels before the bottom component 11 of the craft 10 is cause to be submerged. With the bolts removed, the pegs will engage the plates at the upper ends of the channel members when the bottom component 11 is cause to submerge. As such, when this happens, the bolts may be placed in the upper pair of holes in the channel member walls to underlie the pegs. This would be exemplified by an arrangement of the bolt 121 associated with channel member 108 in the pair 124 of holes in the lateral walls 117 and 118 when the peg 106 is contiguous with the plate 119 (FIG. 10). This is the situation which is also depicted in FIG. 6. This retains the water craft components 11 and 12 in a vertically spaced apart position where maximum depth in the pool area may be enjoyed. Shallower arrangements may be worked out by placing the bolts in the upper or middle pair of holes before the submerging process begins.

The depth of the pool area may be varied from the fore end to the aft end of the pool. This is simply accomplished, for example, by placing the bolts in the front channel members 108 and 109 in say the middle pair of lateral wall holes and the bolts in the rear channel members 115 and 116 in say the upper pair of lateral wall holes before the submerging process. As such, when the compartments of the bottom component 11 are flooded, the bolts of the bottom component 11 will come to rest on the pegs in an arrangement where the deck 17 is inclined rearwardly.

As previously indicated the main section 74 and aft section 75 of the top component of the water craft 10 are connected by a hinge component 76. This component 76 includes a hinge plate 128 that is fixed to the exterior aft wall 84 of the pontoon 80 by means of fasteners 129 (FIG. 3) and a hinge plate 130 that is fixed to the top deck 131 of the aft section 75 by means of fasterners 132 (FIG. 2). These plates 128 and 130 are pivotally interconnected for pivotal movement about a horizontal axis by a pivot element 133.

The top deck 131 of the aft section 75 is generally rectangular as seen in FIG. 2. The section 75 has a depending aft wall 135 that serves as the transom for mounting the motor 13, a pair of right triangular side walls 136 and 137 (FIG. 3) and a bottom wall 138 that inclines forwardly from the bottom of the aft wall 135 to join with the deck along a line that is generally rearwardly offest from the front edge of the deck 131. The deck 131 has an opening 140 that provides a well adjacent the back wall 135 for use in mounting the motor 13. Together with walls 135, 136, 137, and 138, the deck 131 forms a water tight floating structure that is equipped with a transverse bulkhead 139 (FIG. 4) which forms a water tight forward compartment capable of supporting the motor in its operating position when the craft is used as a vehicle as well as in its inoperative position (FIG. 6) when the craft is used as a swimming facility. The deck 131 has a fore part 142 that is capable of resting on the deck 17 of the bottom component 11 just in front of opening 26 (FIG. 4) when the aft section 75 is located in the vehicle mode of operation. This arrangement serves to stop clockwise movement of the aft section 75 (FIG. 4) under the driving force of the propeller during forward operation of the motor 13.

When the bottom and top components 11 and 12 of the water craft 10 are arranged to provide a pool facility, the deck 17 of the bottom component 11 is submerged below the water line 144 (FIG. 6) and the bottom component becomes suspended from the top component 12 of the water craft. Under such circumstances, the pontoon 80 floats at the surface 144 of the water body and the interior side walls 87–90 of the pontoon 80 define the surface area 146 of the swimming pool 145 in the vertical opening 81 provided by the annular pontoon. The portion of the deck 17 within the upright walls 18–21 of the bottom portion 11 of the water craft 10, under such circumstances, provides the bottom portion 147 of the swimming pool 145. On the other hand, the bottom and top components 11 and 12 cooperate, under such circumstance, in providing the side wall portions 148 of the pool 145. Thus, the interior walls 87–90 of the top component 12 and the upright side walls 18–21 of the bottom component 11 provide the side wall portions 148 of the pool.

Figure 9:
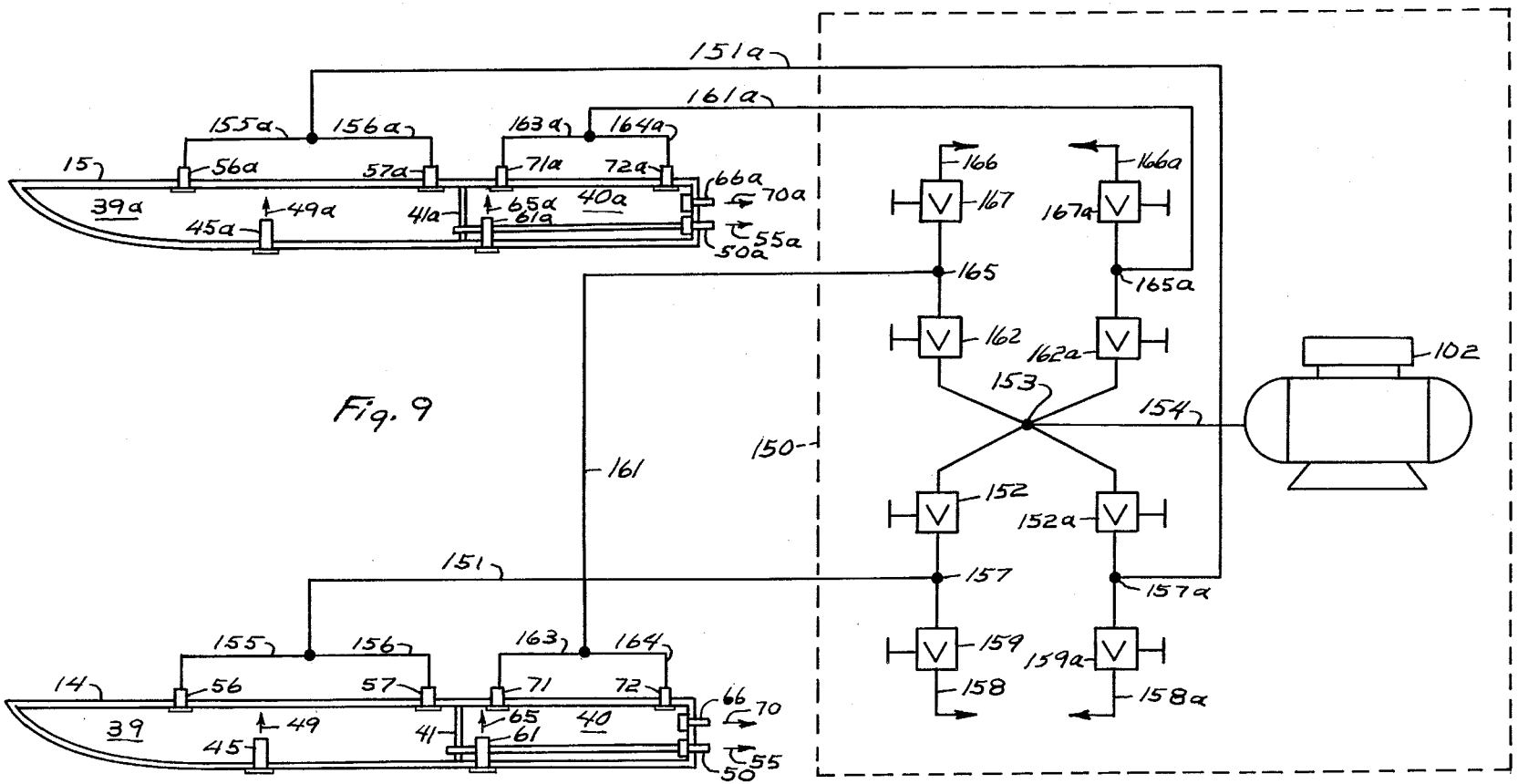
FIG. 9 is a diagramatic view of the system used for moving the structures relative to one another in order to adapt the craft components to the formation of a swimming facility and for use as a vehicle.

The system for vertically moving the bottom component 11 between its first position 77 (FIG. 4) at which the deck 17 is located above the surface 144 of the water and the second position 78 (FIG. 6) at which the deck 17 is submerged below the surface of the water is illustrated in FIG. 9 and generally designated at 150. The system 150 is connected to the pontoon compartments and basically relies on changing the buoyancy of the pontoons of the bottom water craft component 11 by the controlled admission and discharge of water to the fore and aft compartments in the pontoons 14 and 15 as will be seen. The components of the right pontoon 15 are designated in FIG. 9 and in the following discussion by the same numerals used in designating the same components of the left pontoon 14 in FIG. 7 except that the numeral used in designating the right pontoon components also carrys a lower case letter "a" as a suffix.

As will be seen in FIG. 9, the admission and discharge of water from each compartment is separately controllable. As for the fore compartment 39 of pontoon 14, this compartment 39 is connected to the pressurized air source 102 by a line 151 which contains a control valve 152 and, at 153, taps a pressurized air line 154 that is connected to the source 102. The line 151 has parallel branch lines 155 and 156 which connect with the air conduits 56 and 57 that communicate with the interior of the compartment 39.

Valve 152 provides a controllable means for blowing water from compartment 39 so as to increase the buoyancy of the pontoon 14.

When the valve 152 is opened it connects the compartment 39 to the pressurized air source 102 and this, in turn, increases the air pressure in the compartment 39 over that of the hydraulic pressure tending to deliver water to the compartment through the water intake passageway 45, establishes a closed condition for the one-way valve of the passageway 45, and blows any water in the compartment 39 through the water discharge passageway 50 and to the exterior of the pontoon 14. This of corse, renders the pontoon 14 more buoyant. When the water is expelled from the compartment, air is, of course, discharged through the passageway 50 until such time as the valve 152 is closed. When the valve 152 is closed, the compartment pressure stabilizes at a point slightly above the hydraulic pressure that is acting on the one-way valve in passageway 45.

Line 151 is tapped at 157 by a line 158 that connects with the atmosphere through a control valve 159. Valve 159 is normally closed when valve 152 is being manipulated to blow water from compartment 39. However, when valve 152 is closed and the desire is to flood the compartment 39, valve 159 is opened to bleed the pressurized air in the compartment 39 to the atmosphere via the branch lines 155 and 156, line 151 and line 158. As the air is bled off from the compartment, 39, the hydraulic pressure acting on the one-way valve in the water discharge passageway 50 establishes a closed condition and the hydraulic pressure acting on the one-way valve in passageway 45 opens the valve and admits water to the compartment 39 and thus reduces the buoyancy of the pontoon.

As for the aft compartment 40 of pontoon 14, this compartment 40 is connected to the pressurized air source 102 by a line 161 which contains a control valve 162 and, at 153, taps a pressurized air line 154 that is connected to the source 102. The line 161 has parallel branch lines 163 and 164 which connect with the air conduits 71 and 72 that communicate with the interior of the compartment 40.

Valve 162 provides a controllable means for blowing water from compartment 40 so as to increase the buoyancy of the pontoon 14. When the valve 162 is opened it connects the compartment 40 to the pressurized air source 102 and this, in turn, increases the air pressure in the compartment 40 over that of the hydraulic pressure tending to deliver water to the compartment through the water intake passageway 61. This establishes a closed condition for the one-way valve of the passageway 61, and blows any water in the compartment 40 through the water discharge passageway 66 and to the exterior of the pontoon 14. This of corse, renders the pontoon 14 more buoyant. When the water is expelled from the compartment 40, air is, of course, discharged through the passageway 66 until such time as the valve 162 is closed. When the valve 162 is closed, the compartment pressure stabilizes at a point slightly above the hydraulic pressure that is acting on the one-way valve in passageway 61.

Line 161 is tapped at 165 by a line 166 that connects with the atmosphere through a control valve 167. Valve 167 is normally closed when valve 162 is being manipulated to blow water from compartment 40. However, when valve 162 is closed and the desire is to flood the compartment 40, valve 167 is opened to bleed the pressurized air in the compartment 40 to the atmosphere via the branch lines 163 and 164, line 161 and line 166. As the air is bled off from the compartment 40, the hydraulic pressure acting on the one-way valve in the water discharge passageway 66 establishes a closed condition and the hydraulic pressure acting on the one-way valve in passageway 61 opens the valve and admits water to the compartment 40 and thus reduces the buoyancy of the pontoon.

The arrangement is substantially the same for admitting and discharging water from the compartments **39*a* and 40*a* of pontoon 15. Thus, compartment 39*a* is connected to the pressurized air source 102 by a line 151*a* which contains a control valve 152*a* and, at 153, taps the pressurized air line 154 that is connected to the source 102. The line 151*a* has parallel branch lines 155*a* and 156*a* which connect with the air conduits 56*a* and 57*a* that communicate with the interior of the compartment 39*a*. The line 151*a* is tapped at 157*a* by a line 158*a* that connects connects with the atmosphere through a control valve 159*a*. The operation of valves 152*a* and 159*a* to control the admission and discharge of water from compartment 39*a* is the same as described for valves 152 and 159 to control the admission and discharge of water from compartment 39**.

Compartment **40*a* is connected to the pressurized air source 102 by a line 161*a* which contains a control valve 162*a* and, at 153, taps a pressurized air line 154 that is connected to the source 102. The line 161*a* has parallel branch lines 163*a* and 164*a* which connect with the air conduits 71*a* and 72*a* that communicate with the interior of the compartment 40*a*. The line 161*a* is tapped at 165*a* by a line 166*a* that connects with the atmosphere through another control valve 167*a*. The operation of valves 162*a* and 167*a* to control the admission and discharge of water from compartment 40*a* is the same as described for valves 162 and 167 to control the admission and discharge of water from compartment 40**.

It will be apparent that in flooding or blowing the compartments the task is usually carried out simultaneously in all compartments so as to attain uniform vertical movements of the bottom component 11 of the water craft under the changing buoyant conditions brought about by the flooding or blowing process.

From the foregoing it is evident that the current water craft may be used as a swimming facility as well as a vehicle. When used as a vehicle, the deck 17 is of course located above the surface of the water and the area of the deck 17 beneath the vertical opening 81 serves as a passanger area.

While only one embodiment of this invention has been shown and described by way of illustration, many modifications will occur to those skilled in the art and it is, therefore, desired that it be understood that it is intended herein to cover all such modifications that fall within the true spirit and scope of the invention.

What is claimed as new and what is desired to secure by Letters Patent of the United States follows:

1. A water craft adapted and arranged to float on the surface of a water body comprising:

(a) a first floatable structure having a deck, (b) controllable means connected with the first floatable structure and controllable to vertically move the first floatable structure between a first position at which said deck is located above the surface of the water and a second position at which said deck is submerged below the surface of the water, (c) a second floatable structure which is moveable relative to the first floatable structure and has a floatable section with a vertical opening that overlies said deck and which is supported by said first floatable structure when said first floatable structure is at said first position therefor, and (d) means mounted on the second floatable structure for propelling the craft through the water;

said second structure being arranged to float on the water surface when said first structure is at said second position and to thereat define the surface area of a swimming pool within said vertical opening, said deck being arranged to provide a bottom portion of the swimming pool when said first structure is at said second position and to provide a passenger area when said first structure is at said first position, and said first and second structures being arranged to cooperate in providing side wall portions of said swimming pool when said first structure is at said second position.

2. A water craft in accord with claim 1 wherein said first floatable structure has a pair of elongated hulls that are laterally spaced apart and thereabove support said deck.

3. A water craft in accord with claim 1 wherein said first floatable structure has a pair of elongated hulls that are laterally spaced apart and thereabove support said deck, each of said hulls has a pair of water tight compartments that are respectively located fore and aft in the hull structure, each of said compartments has a first water passageway for admitting water to the compartment which includes a water inlet communicating with the exterior of the hull at the bottom of the compartment, a water discharge outlet located in the compartment above the water inlet, and a one-way valve for limiting the direction of water flow in the first water passageway, each of said compartments has passageway means connected to the controllable means for admitting and discharging compressed air from the compartment, and each of said compartments has a second water passageway for discharging water from the compartment which includes a water inlet communicating with the compartment, a water outlet communicating with the exterior of the hull, and a one-way valve for limiting the direction of water flow in the second water passageway.

4. The water craft in accord with claim 1 wherein said first floatable structure has a pair of elongated hulls that are laterally spaced apart and thereabove support said deck, each of said hulls has a pair of water tight compartments respectively located fore and aft in the hull structure, each of said compartments has a first water passageway for admitting water to the compartment which includes a water inlet communicating with the exterior of the hull at the bottom of the compartment, a water discharge outlet located in the compartment above the water inlet, and a one-way valve for limiting the direction of water flow in the first water passageway, each of said compartments has passageway means connected to the controllable means for admitting and discharging compressed air from the compartment, each of said compartments has a second water passageway for discharging water from the compartment which includes an inlet communicating with the compartment, an outlet communicating with the exterior of the hull, and a one-way valve for limiting the direction of water flow in the second water passageway, and said controllable means includes a pressurized air source connected to the compressed air admitting and discharging passageway means of each compartment.

5. A water craft in accord with claim 1 wherein said first floatable structure has an upright wall which cooperated with the second structure to provide the side walls of said swimming pool when said first structure is at said second position.

6. A water craft in accord with claim 1 wherein said second floatable structure has a floatable aft section that is mounted for pivotal movement about a horizontal axis, and said propelling means is mounted on said aft section.

7. A water craft in accord with claim 1 wherein said first floatable structure has a pair of elongated hulls that are laterally spaced apart and thereabove support said deck, said second floatable structure has a floatable aft section that is mounted for pivotal movement about a horizontal axis in the space between said hulls, and said propelling means is mounted on said aft section.

8. A water craft in accord with claim 1 further comprising adjustable means for interconnecting said first and second structures at said first and second positions of said first structure.

* * * * *